US006655552B2

(12) United States Patent
Aiken et al.

(10) Patent No.: US 6,655,552 B2
(45) Date of Patent: Dec. 2, 2003

(54) HEATING AND DISPENSING FLUIDS

(75) Inventors: Patrick T. Aiken, Falmouth, MA (US); Jon R. Rossman, Chelmsford, MA (US); Bryan R. Hotaling, Arlington, MA (US); Thomas A. Hagerty, Somerville, MA (US)

(73) Assignee: Aiken Industries, Inc., MA (US)

( * ) Notice: Subject to any disclaimer, the term of this patent is extended or adjusted under 35 U.S.C. 154(b) by 0 days.

(21) Appl. No.: 09/875,676

(22) Filed: Jun. 6, 2001

(65) Prior Publication Data

US 2002/0017532 A1 Feb. 14, 2002

Related U.S. Application Data

(60) Provisional application No. 60/223,995, filed on Aug. 9, 2000.

(51) Int. Cl.[7] ..... B67D 5/62
(52) U.S. Cl. ..... 222/146.3
(58) Field of Search ..... 222/146.1–146.6, 222/402.1

(56) References Cited

U.S. PATENT DOCUMENTS

| | | | |
|---|---|---|---|
| 1,827,649 | A | 10/1931 | Gallipoli et al. |
| 2,060,440 | A | 11/1936 | Rosenblad |
| 2,873,351 | A | 2/1959 | Lannert |
| 3,043,484 | A | 7/1962 | Jolly |
| 3,069,528 | A | 12/1962 | Gardner |
| 3,095,122 | A | 6/1963 | Lewiecki et al. |
| 3,098,925 | A | 7/1963 | Fouts et al. |
| 3,111,967 | A | 11/1963 | Bullard |
| 3,175,733 | A | 3/1965 | Lerner |
| 3,184,114 | A | 5/1965 | Minear |
| 3,207,369 | A | 9/1965 | Rossi |
| 3,217,937 | A | 11/1965 | Kasparian |
| 3,217,938 | A | 11/1965 | Ayres |
| 3,236,420 | A | 2/1966 | Leika |
| 3,236,421 | A | 2/1966 | Glazier |
| 3,240,396 | A | 3/1966 | Friedenberg |
| 3,241,723 | A | 3/1966 | Lerner |
| 3,241,724 | A | 3/1966 | Lerner |
| 3,253,748 | A | 5/1966 | Callahan |
| 3,258,170 | A | 6/1966 | Ayres et al. |
| 3,258,171 | A | 6/1966 | Reich et al. |
| 3,263,744 | A | 8/1966 | MacKeown |
| 3,281,018 | A | 10/1966 | Abplanalp et al. |
| 3,291,346 | A | 12/1966 | Marraffino |
| 3,292,823 | A | 12/1966 | Weidman et al. |
| 3,300,095 | A | 1/1967 | Marraffino |
| 3,308,993 | A | 3/1967 | Bruno |
| 3,314,572 | A | 4/1967 | Pungitore |
| 3,338,476 | A | 8/1967 | Marcoux |
| 3,338,477 | A | 8/1967 | McKinnie |
| 3,339,806 | A | 9/1967 | Reich et al. |
| 3,347,422 | A | 10/1967 | Mead et al. |

(List continued on next page.)

FOREIGN PATENT DOCUMENTS

| | | |
|---|---|---|
| EP | 0538528 A1 | 4/1993 |
| FR | 1 506 685 | 12/1967 |

OTHER PUBLICATIONS

Invitation to Pay Additional Fees for Application PCT/US01/24983, mailed Mar. 6, 2002.

*Primary Examiner*—Philippe Derakshani
(74) *Attorney, Agent, or Firm*—Fish & Richardson P.C.

(57) ABSTRACT

A heat transfer cap assembly for use with a dispensing canister containing a pressurized product, such as shaving gel. The cap assembly defines a volume for retaining hot tap water to heat gel in a thermal conductor forming a conduit between a nozzle adaptor and an outlet in the side of the cap assembly. When the nozzle is released, the conduit moves out of alignment with the outlet so as to block any 'drool' of the gel remaining in the conduit during later expansion. The outer cap is rotatable to a lock position to disallow activation of the nozzle and to further block the outlet.

44 Claims, 8 Drawing Sheets

U.S. PATENT DOCUMENTS 3,358,882 A 12/1967 Mathison
3,370,756 A 2/1968 McKinnie
3,372,840 A 3/1968 Kelley
3,399,810 A 9/1968 Burne
3,497,110 A 2/1970 Bombero et al.
3,502,842 A 3/1970 Day
3,518,410 A 6/1970 Dillarstone
3,527,922 A 9/1970 Reich et al.
3,559,850 A 2/1971 Barkin et al.
3,576,279 A 4/1971 Ayres et al.
3,578,945 A 5/1971 Ayres et al.
3,588,469 A 6/1971 Dillarstone
3,618,810 A 11/1971 Wilson
3,644,707 A 2/1972 Costello
3,680,738 A 8/1972 Vos et al.
3,722,753 A 3/1973 Miles
3,749,880 A 7/1973 Meeks
3,790,033 A 2/1974 Ciaffone
3,891,827 A 6/1975 Wyse
3,917,121 A 11/1975 Ciaffone
3,933,276 A 1/1976 Packham et al.
3,990,612 A 11/1976 Gasser
3,997,083 A 12/1976 McNair
4,000,834 A 1/1977 Whiley
4,024,987 A 5/1977 Myles
4,027,786 A 6/1977 Ryckman, Jr.
4,056,707 A 11/1977 Farnam
4,067,480 A 1/1978 Gasser
4,069,949 A 1/1978 Ryckman, Jr.
4,089,609 A 5/1978 Gring et al.
5,060,829 A 10/1991 Evans
5,379,926 A 1/1995 Mueller et al.
5,544,701 A 8/1996 Elder

HEATING AND DISPENSING FLUIDS

CROSS-REFERENCE TO RELATED APPLICATIONS

This application claims priority under 35 U.S.C. §119(e) from U.S. provisional patent application No. 60/223,995, filed Aug. 9, 2000, the entire contents of which are incorporated herein by reference as if entirely set forth.

TECHNICAL FIELD

This invention relates to heating and dispensing fluid, such as shaving creams, gels, foams, oils and the like, in limited amounts.

BACKGROUND

Many fluid consumer products, such as shaving cream foams and gels, are packaged and sold in closed containers, such as pressurized cans, with manually operated dispensers for releasing a limited amount of the product for each use. Improvements in such dispensers are desired. Additionally, it is frequently useful to heat such products before they are applied to the skin, for improved comfort.

Pressurized products such as shaving gels, for example, can feel particularly cold against the skin as dispensed, owing to the cooling effect of the thermodynamic expansion of the gel from the can. After showering, the contact of this direct dispensed product can be perceived as even colder on the warmed skin. Some efforts have been made to heat shaving products as they are dispensed, such as by electric heater appliances. Others have employed hot tap water to heat the shaving products within the can before they are dispensed.

Many pressurized products contain propellants within the product itself. After a desired amount of product has been dispensed, some amount of unwanted 'dribbling' or 'drooling' from the nozzle may be experienced, due to subsequent expansion of product within the dispenser.

SUMMARY

The invention features an improved dispenser for fluid containers, with particular applicability to pressurized cans of products such as shaving creams, lotions, foams and gels.

According to one aspect of the invention, a pressurized can of flowable material has a body defining an interior volume containing the flowable material in a pressurized condition, a valve operable to dispense a selected amount of the flowable material from the can through an outlet at an exterior surface of the can, and, between the interior volume of the body and the valve, a heat transfer device. The heat transfer device includes an exterior housing defining an interior volume adapted to receive and hold a quantity of water at a temperature differing from that of the flowable material, and a conduit contained within the housing and forming a flow path for the flowable material between an outlet orifice of the interior volume and the valve. The conduit is adapted to contain a quantity of pressurized, flowable material as thermal energy is transferred through the conduit between the water and the contained quantity of flowable material, and the valve is disposed proximate the outlet and is adapted to prevent flow of pressurized material through the outlet when released.

Preferably, the can defines a released material flow path, between the valve and the outlet, having a volume of no more than 0.05 cubic centimeters (more preferably, no more than 0.02 cubic centimeters) for containing unpressurized material downstream of the valve.

In some embodiments, the can also includes an operable valve at the outlet orifice of the interior volume of the body, and an exposed surface adapted to operate both valves when manually manipulated.

The valve, in some preferred constructions, comprises a sliding face seal at an outlet surface of the conduit, preferably disposed less than about 0.050 inch (1.3 millimeters) from the exterior surface of the can.

The invention is particularly useful in applications in which the pressurized material contains a propellant, and in which the pressurized material expands upon being released through the valve. Examples of pressurized materials for which the invention is well suited include gels and shaving products.

For shaving applications, the conduit is preferably adapted to contain a quantity of flowable product sufficient for shaving a man's face.

For particularly advantageous thermal response, we recommend that the conduit have an effective thermal mass, in some cases, of less than about 8 Joules per degree Kelvin (preferably, less than about 6 Joules per degree Kelvin). It is also desirable that, in some instances, the conduit material have a thermal conductivity of at least 0.3 watts per meter-degree Kelvin.

The conduit may be made of plastic resin, for example, with a nominal wall thickness, between water in contact with an outer surface of the conduit and flowable material contained within the conduit, of preferably less than about 0.050 inch (1.3 millimeters), more preferably less than about 0.030 inch (0.76 millimeters). The conduit defines, in some cases, a spiral flow path for the flowable material.

In some embodiments, the conduit is adapted to contain at least 1/10 fluid ounce (preferably, at least 1/6 fluid ounce, and more preferably, at least 1/3 fluid ounce) (at least 3 cubic centimeters, preferably at least 5 cubic centimeters, more preferably at least 10 cubic centimeters) of flowable material.

Preferably, the heat transfer device is constructed of materials selected to safely withstand filling the housing of the heat transfer device with water at about 140 degrees Fahrenheit, for heating the flowable material contained within the conduit. Preferred materials include, for example, polyethylene, polypropylene and polystyrene.

In some embodiments, the can has a valve actuator exposed for engagement by a human finger and adapted to be moved from a first position, in which the actuator is blocked from actuating the valve, to a second position, in which the actuator actuates the valve to dispense flowable material when depressed. The can may also have an operable valve at the outlet orifice of the interior volume of the body, with the actuator being blocked from actuating the valves in its first position, but actuates both valves when depressed in its second position.

Particularly for use as a shaving lubricant dispenser, the can ideally should be adapted to dispense at least four cubic centimeters of temperature-modified, flowable material, as measured volumetrically prior to any expansion, within less than about six seconds, upon valve actuation.

According to another aspect of the invention, a pressurized can of flowable material is provided for retail sale. The can includes a cylindrical body having an outer diameter and a length and defining an interior volume containing the flowable material in a pressurized condition, and, coupled to an upper end of the body, a heat transfer assembly having an overall height, measured from the upper end of the cylindrical body, of less than about 3 inches, and being substantially contained within an extended cylindrical volume defined by the outer diameter of the body. The heat transfer assembly has an exterior housing defining an interior volume adapted to receive and hold a quantity of water with the can in an upright position, the exterior housing containing a valve operable to dispense a selected amount of the flowable material from the can, and a conduit within the interior volume of the exterior housing for submersion in the quantity of water and forming a flow path for the flowable material through the heat transfer assembly. The conduit is adapted to contain at least three cubic centimeters of pressurized, flowable material as thermal energy is transferred through the conduit between the water and the contained quantity of flowable material.

The valve is preferably disposed proximate an outlet at an exterior surface of the can and is adapted to prevent flow of pressurized material through the outlet when released.

In many useful applications, the pressurized material contains a propellant and is formulated for application to skin.

According to another aspect of the invention, a heat transfer cap assembly is provided for use with a dispensing canister containing a pressurized shaving product. The cap assembly includes a rail mount disposed at a lower end of the cap assembly and constructed to clamp onto an upper edge of the dispensing canister, and an outer shell defining an interior volume configured to receive and hold a quantity of hot water. An actuator of the cap assembly is exposed for finger operation and arranged to depress a release nozzle of the canister to dispense shaving product into the cap assembly when operated. A heat exchanger is arranged to receive shaving product released from the nozzle. The heat exchanger is disposed with the outer shell for exposure to hot water, and configured to hold at least ⅓ fluid ounce of shaving product while heat is transferred from the hot water, through the heat exchanger, to the shaving product held within the heat exchanger. The cap assembly also includes a spout, such as an iris valve, through which heated product is dispensed from the heat exchanger, the spout adapted to close to prevent extended exposure of shaving product remaining in the heat exchanger to air.

In some embodiments, the cap assembly also has a barrier disposed between the interior volume of the outer shell and an upper surface of the canister and configured to prevent hot water in the cap assembly from contacting the canister.

In some cases the spout is a valve formed by alignable holes in two adjacent surfaces movable to place the holes in alignment for dispensing heated product, and to misalign the holes to prevent hydraulic communication through the valve.

According to another aspect of the invention, a heat transfer cap assembly is provided for use with a dispensing canister containing a pressurized product. The cap assembly includes a can adaptor, a trunk, a thermal conductor and a top cap. The can adaptor has an axially extending skirt constructed to snap about an upper edge of the dispensing canister to secure the cap assembly on the canister, and an axially displaceable nozzle adaptor secured to the skirt by a resilient membrane and positioned to align with a nozzle of the canister when the cap assembly is so secured. The trunk has an axially extending skirt configured to snap about an upper edge of the can adaptor to secure the trunk to the can adaptor, and a sleeve extending axially from an upper end of the skirt. The trunk also defines a radial hole extending through one side of the sleeve. The thermal conductor is disposed within the trunk and axially displaceable with respect to the trunk. The thermal conductor forms a conduit between the nozzle adaptor and a conductor outlet disposed adjacent the hole in the trunk sleeve, with the outlet positioned to align with the trunk sleeve hole when the thermal conductor is pressed downward to press against the nozzle adaptor to actuate the nozzle. The top cap is axially secured to the trunk and has a button with an extending stem for engaging and pressing against the thermal conductor when the button is resiliently depressed. The top cap, trunk and can adaptor together define an interior cavity for receiving hot water through an upper surface of the top cap, and containing the hot water in direct contact with the thermal conductor to heat pressurized product contained within the thermal conductor.

In some embodiments, the top cap has a skirt extending about the sleeve of the trunk and defining a hole therethrough, the top cap skirt being rotatable with respect to the trunk from an open position, in which the top cap skirt hole aligns with the trunk sleeve hole for dispensing product, to a closed position in which the top cap skirt blocks communication through the trunk sleeve hole.

In some cases, the trunk has an upper surface defining an aperture therein. The top cap button has a projection extending therefrom and positioned to be received with the aperture as the button is depressed with the top cap in a first rotational position with respect to the trunk, and to engage the upper surface of the trunk to inhibit movement of the button with the top cap in a second rotational position with respect to the trunk.

The sleeve of the trunk, in some applications, contains guide means for maintaining a radial positioning of the thermal conductor as the thermal conductor is axially displaced within the trunk.

According to yet another aspect of the invention, a pressurized can of shaving lubricant includes a body defining an interior volume containing the shaving lubricant in a pressurized condition, a valve operable to dispense a desired amount of the shaving lubricant from the interior volume of the body, and a cap assembly mounted to the body. The cap assembly has a trigger surface exposed for manual manipulation by a user, a valve actuator operably connected to the trigger surface and positioned to operate the valve as the trigger surface is manipulated, and a flow conduit hydraulically connecting the valve to an outlet defined in an outer surface of the cap assembly. The outer surface of the cap assembly is rotatable with respect to the flow conduit from an open position, in which the outlet aligns with the flow conduit with the trigger surface manipulated to dispense shaving lubricant, to a closed position blocking the flow conduit.

In some instances, the outer surface of the cap assembly is of a rotatable top cap with an inner surface arranged to form a face seal against an outlet orifice of the flow conduit when the top cap is rotated to a locked position. Preferably, the outlet circumscribes a volume, downstream of the outlet orifice of the flow conduit, of less than about 0.05 cubic centimeters.

In some embodiments, the flow conduit is defined within a conduit housing constructed to move axially with respect to the outlet as the trigger surface is depressed, to both align the flow conduit with the outlet and operate the valve.

In some cases, an inner surface of the cap assembly carries indicia that align with a corresponding aperture in the top cap to provide a visible indication that the cop cap is in its locked or unlocked position.

According to another aspect of the invention, a pressurized can of shaving lubricant includes a body defining an interior volume containing the shaving lubricant in a pressurized condition, a valve operable to dispense a desired amount of the shaving lubricant from the interior volume of the body, and a cap assembly mounted to the body and having an outer surface defining an outlet. The cap assembly has a trigger surface exposed for manual manipulation by a user and operably connected to the valve for opening the valve as the trigger surface is manipulated. The cap assembly also has a flow conduit housing connected to the trigger surface to move with respect to the outer surface outlet as the trigger surface is manipulated, the flow conduit housing defining therein a flow conduit hydraulically connecting the valve to a conduit outlet orifice positioned to align with the outer surface outlet when the trigger surface is manipulated to open the valve to dispense the shaving lubricant, and to be blocked when the trigger surface is released.

In some cases, the flow conduit housing is free to move axially with respect to the outer surface outlet as the trigger surface is depressed.

In some preferred constructions, the cap assembly defines an interior volume for receiving and holding hot water, the flow conduit housing forming a heat exchanger contained within the interior volume of the cap assembly and adapted to transfer heat from hot water to shaving lubricant contained within the flow conduit.

The flow conduit may be in the form of a spiral, for example.

According to another aspect of the invention, a method of heating and dispensing shaving product is provided. The method includes filling the interior volume of the heat transfer device of one of the above-described pressurized cans with heated water, operating the valve of the can to dispense a selected amount of the flowable material through the outlet at the exterior surface of the can, and then emptying the water from the interior volume of the heat transfer device.

According to another aspect of the invention, another method of heating and dispensing shaving product is provided. The method includes operating the valve of one of the above-described pressurized cans to dispense a selected amount of the flowable material through the outlet defined in an outer surface of the cap assembly, and then rotating the outer surface of the cap assembly to its closed position to block the flow conduit and inhibit further dispensing of shaving product.

According to another aspect of the invention, another method of heating and dispensing shaving product is provided. The method includes manipulating the trigger surface of one of the above-described pressurized cans, thereby both aligning the flow conduit with the outer surface outlet and opening the valve to dispense the shaving lubricant; and then releasing the trigger surface, thereby blocking the flow conduit at the outlet in the outer surface of the cap assembly to inhibit further flow of shaving lubricant from the flow conduit.

Implemented as described herein, the dispenser of the invention can provide for rapid heating or cooling of a single dose of pressurized product, such as shaving gel, within a package size and at a cost appropriate for incorporation on retail product cans. Relying on hot tap water for its source of heat and not requiring any electrical or expensive components, this heating dispenser can be truly disposable. In preferred embodiments there need not be any cap to be repeatedly removed and replaced (or lost), and post-use 'drool' is effectively eliminated by placing a closable, pressure-resistant valve extremely close to the dispenser outlet. No changes to existing pressurized canisters need be required.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
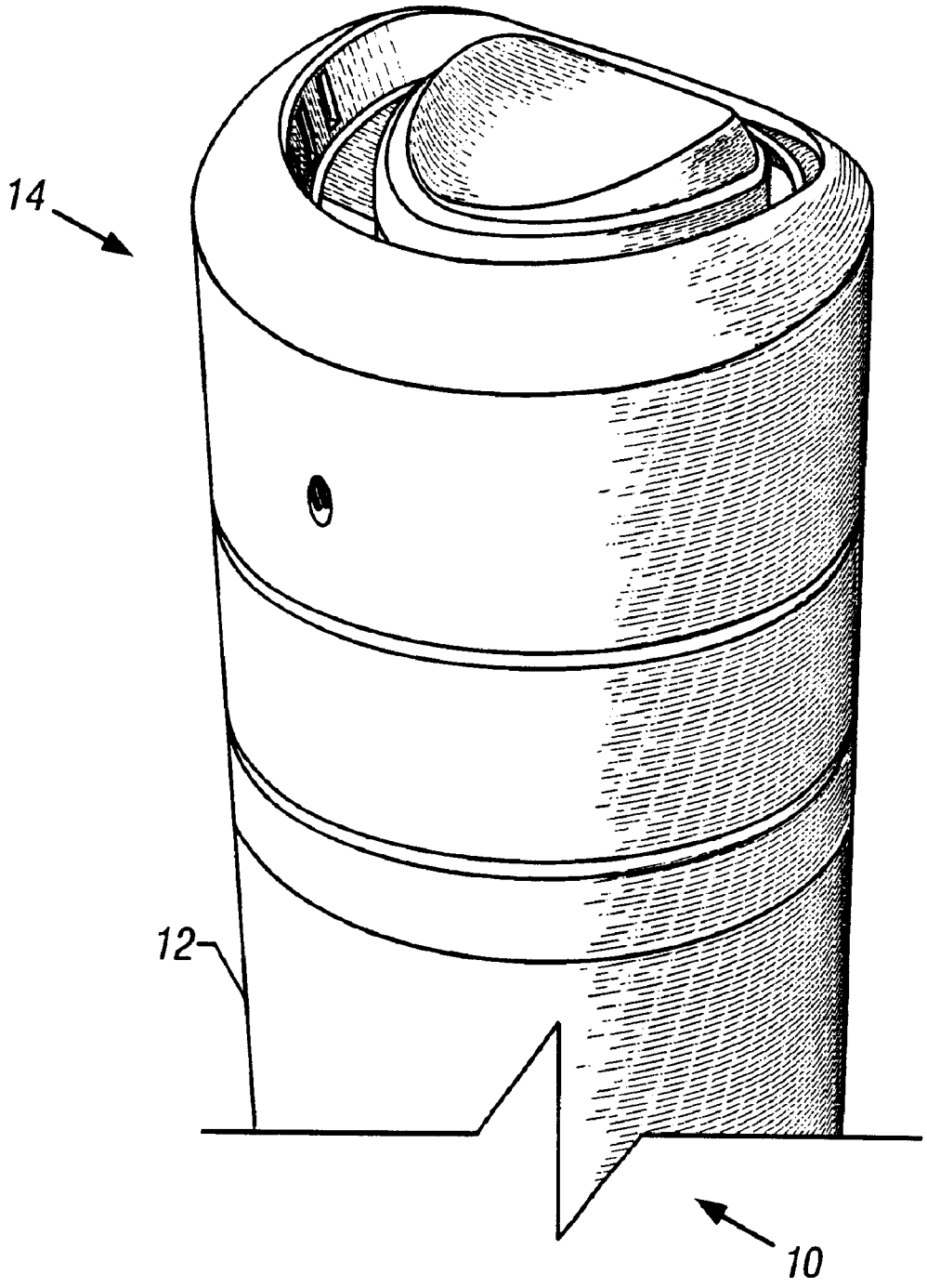
FIG. 1 is a perspective view of the top of a can of shaving gel.
Figure 1A:
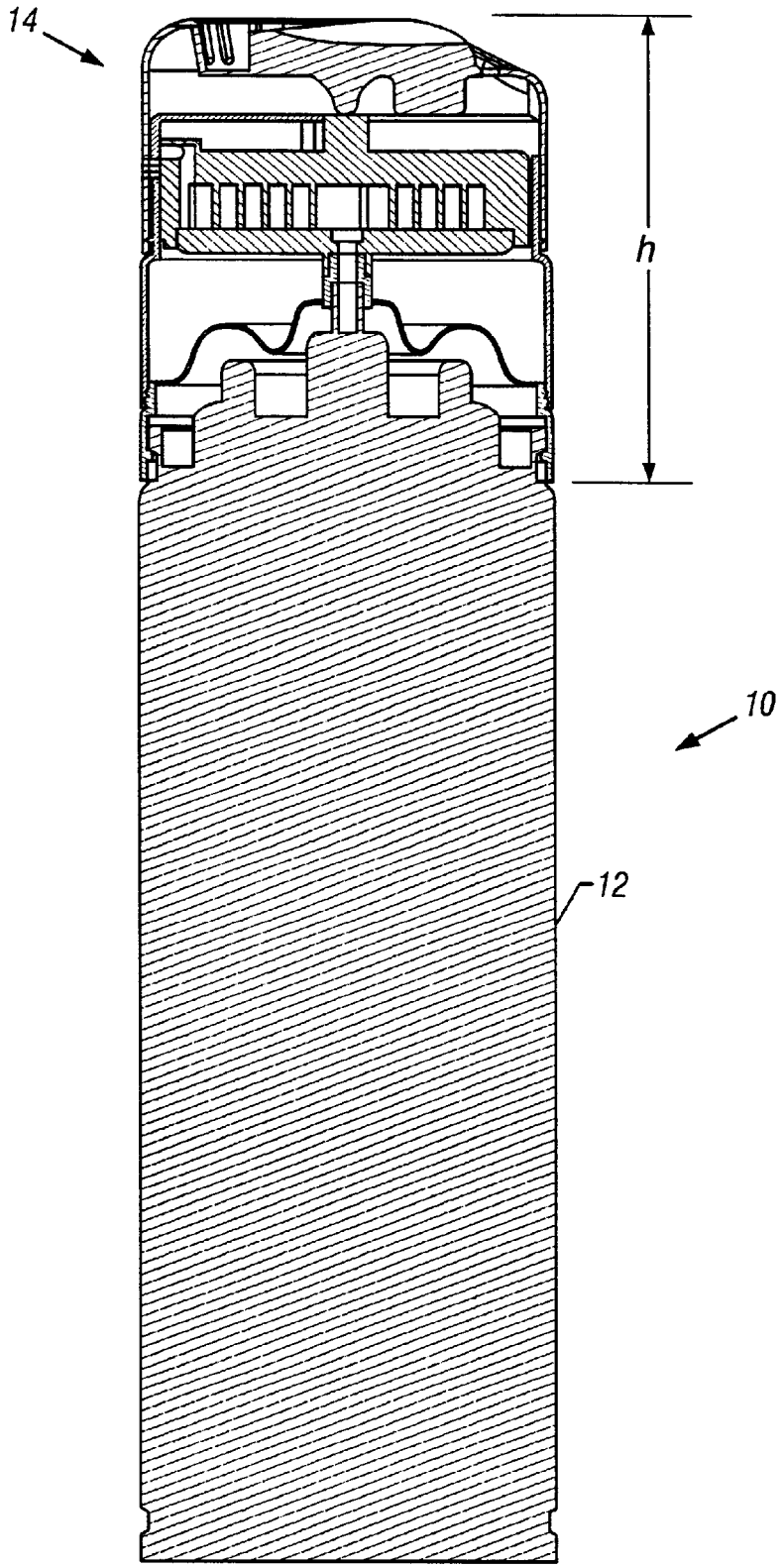
FIG. 1A is a vertical cross-section through the can of shaving gel.

Referring first to FIGS. 1 and 1A, a pressurized can 10 of shaving gel is configured for retail sale and consists of a cylindrical metal can 12 filled with gel at an internal gage pressure of about 35 to 40 pounds per square inch, and a gel dispenser assembly 14 mounted on the upper end of can 12. As will be described more fully below, dispenser 14 is adapted to both heat and dispense gel from can 12, employing hot water such as from a bathroom sink faucet. To accommodate standard cans of typical volumes and still fit within expected shelf space, both for retailers and in the home, the dispenser assembly 14 does not appreciably extend radially beyond the outer diameter of can 12, and has an overall height "h" of only about 2.25 inches (5.72 centimeters).

Figure 2:
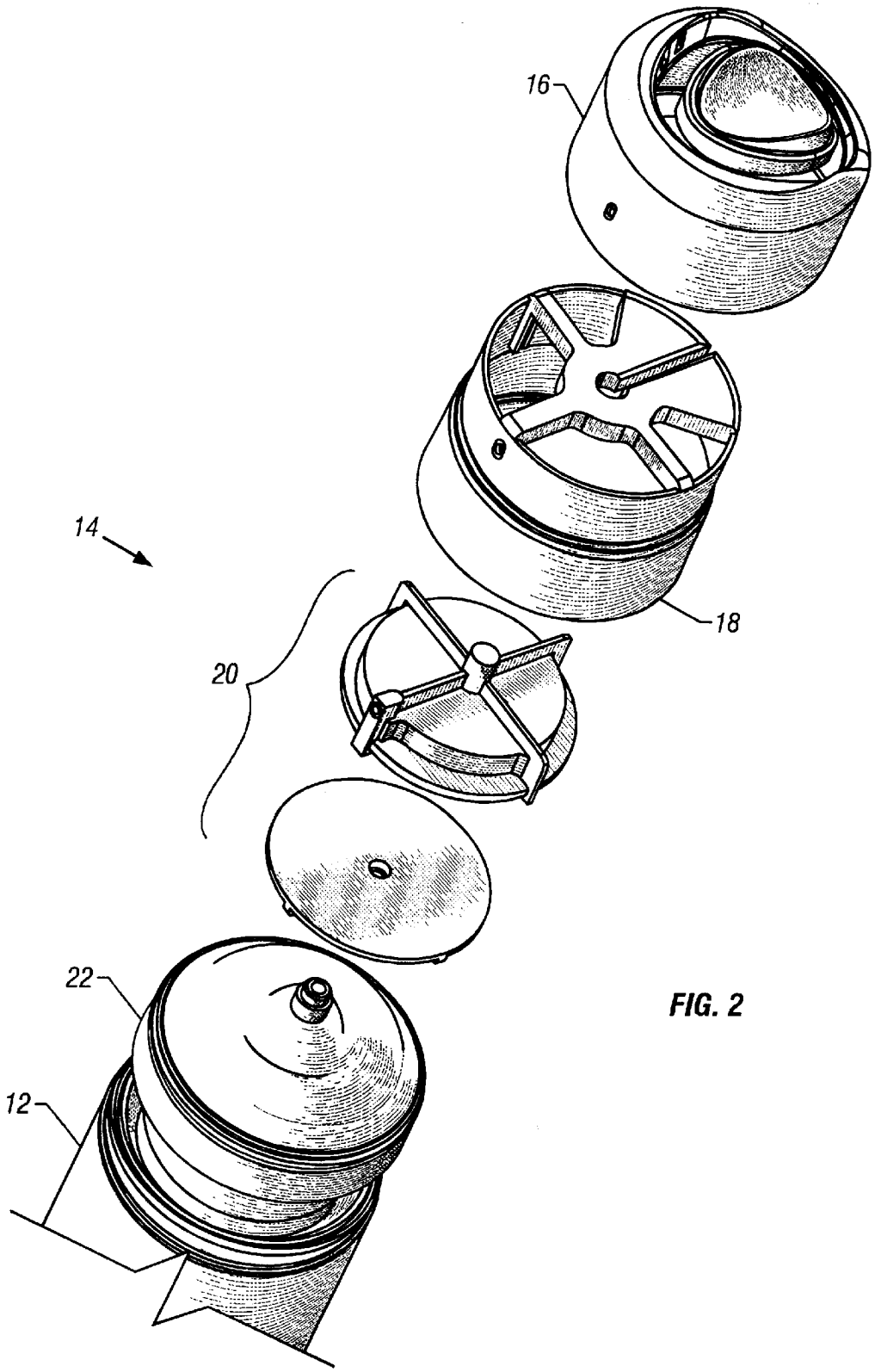
FIG. 2 is an exploded view of the dispenser assembly.

As shown in the exploded assembly view of FIG. 2, dispenser assembly 14 consists of four plastic components. From top to bottom, as assembled, these are: a top cap 16, a trunk 18, a thermally conductive gel conduit 20, and a can adaptor 22. These four generally circular components together form a lockable, manually operable valve for dispensing a desired quantity of gel (typically, enough for a single usage or shave), and a gel heater. They can be assembled together as a subassembly and then mounted on a can of shaving gel or foam, or other pressurized personal care product, or assembled sequentially to the can.

Figure 3:
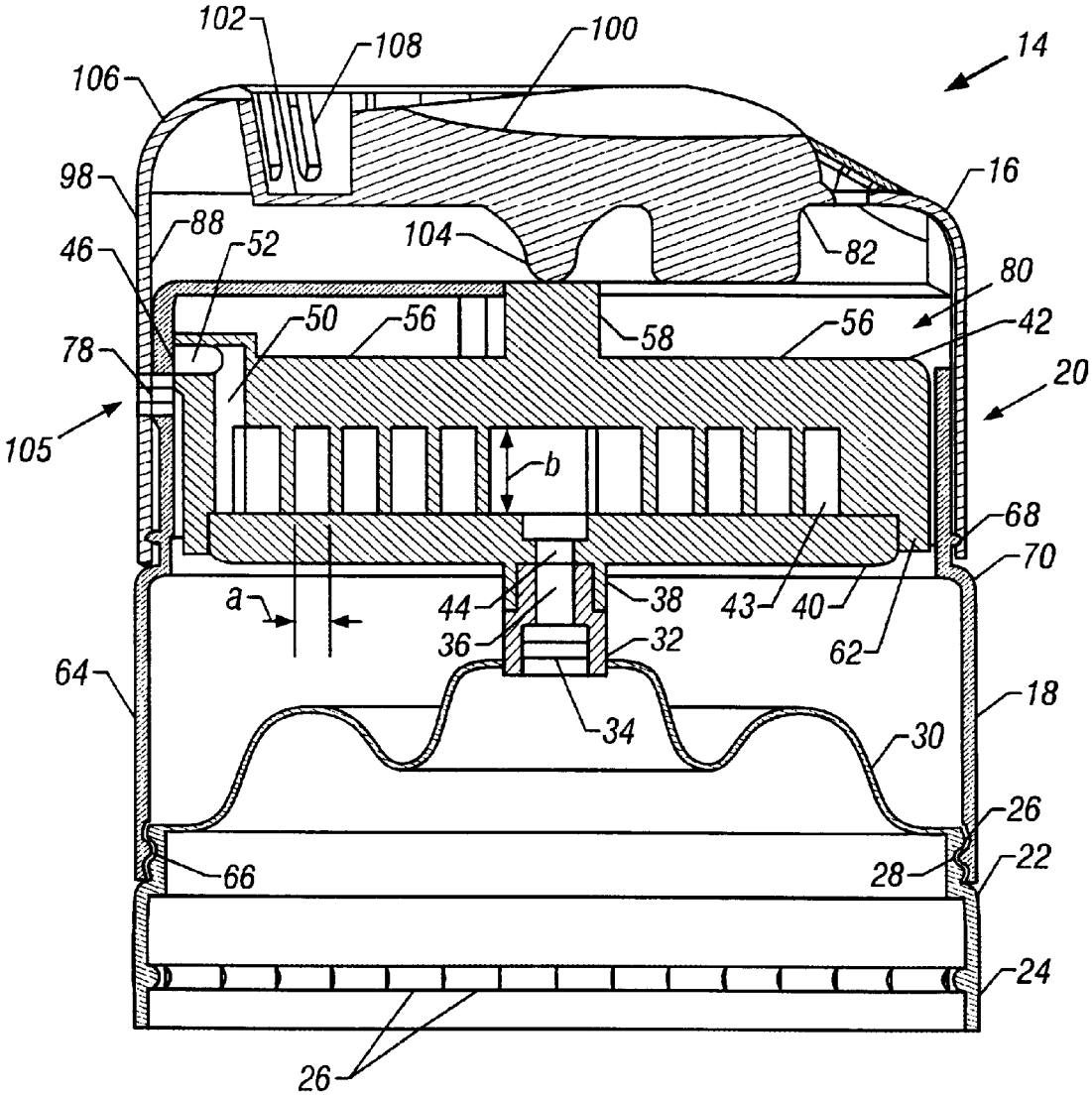
FIG. 3 is an enlarged view of the dispenser assembly cross-section.

Referring next to the cross-section of FIG. 3, axisymmetric can adaptor 22 is molded of polyethylene and has a circular skirt 24 of about 2.0 inch (5.1 centimeter) diameter extending downward to secure the dispenser assembly to the top edge of a standard shaving gel can. About the inner surface of skirt 24 is a series of coplanar ribs 26 arranged to engage the underside of an upper lip of the can to retain the can adaptor to the can as snapped in place. Just above skirt 24 is a shoulder 26 defining a circumferential groove 28 for receiving a rib of the trunk 18 in snap fit. A flexible, impermeable membrane 30 extends radially inward from the upper edge of shoulder 26 to an integrally molded valve adaptor 32 at the center of the can adaptor, and forms a barrier to keep hot water from coming into contact with the metal upper face of the can. Membrane 30 is molded with a nominal thickness of only about 0.020 inch (0.51 millimeters), and of the curved cross-section shown, to permit the membrane to repeatedly flex and function as an axial spring. Valve adaptor 32 is counterbored to slip over the standard valve stem (not shown) of the can and has a small, upwardly directed lip 34 sized to engage and seal against the outer surface of the cylindrical valve stem. As valve adaptor 32 is pushed downward from its normal position shown, membrane 30 resiliently flexes as valve adaptor 32 displaces the standard valve stem of the can (not shown) to dispense gel upward from the can through the hollow bore 36 of the valve adaptor. The upper end of valve adaptor 32 is stepped to receive and seal against a flange 38 surrounding the gel inlet of gel conduit 20.

Figure 4:
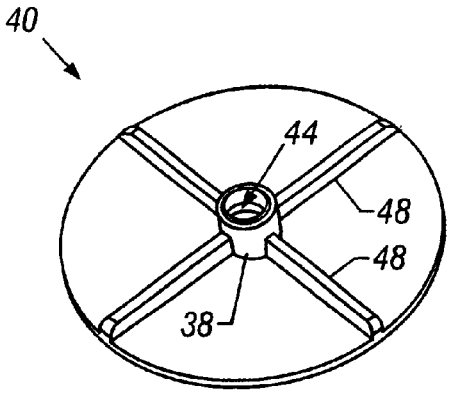
FIG. 4 is a bottom perspective view of the inlet cover of the gel conduit.
Figure 5:
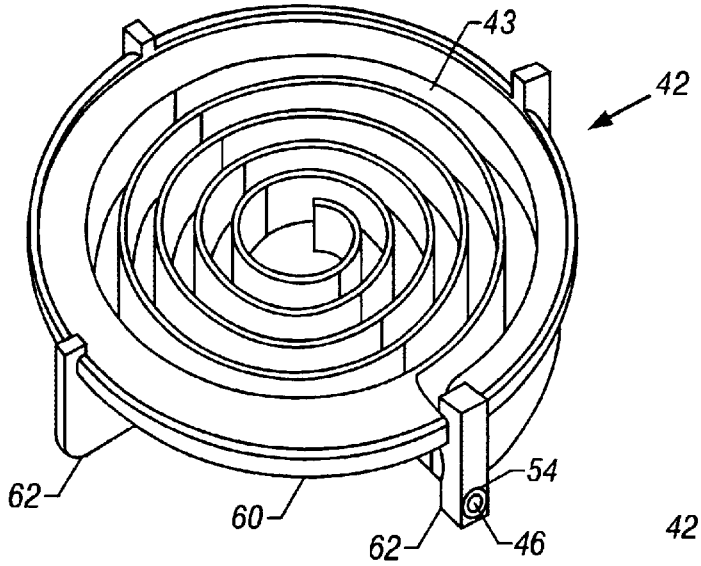
FIG. 5 is a bottom perspective view of the outlet body of the gel conduit.
Figure 6:
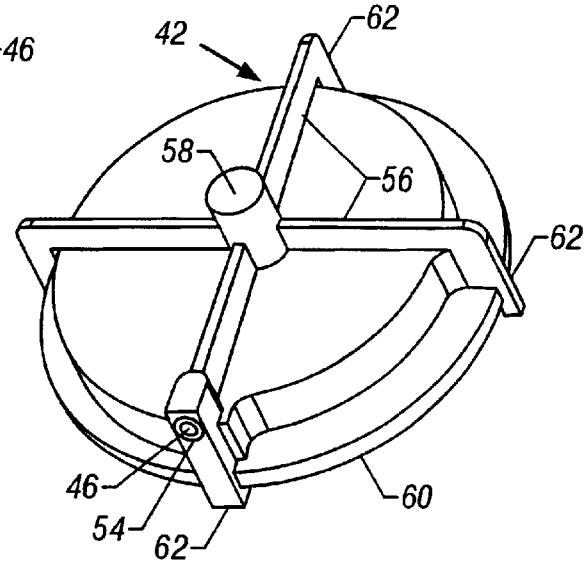
FIG. 6 is a top perspective view of the outlet body of the gel conduit.

Referring also to FIGS. 4–6, gel-conduit 20 consists of an inlet cover 40 and an outlet body 42, which are molded separately of polyethylene and then pressed together to define a sealed, spiral flow path 43 from the inlet 44 at the center of inlet cover 40 to an outlet 46 at an upper, radial edge of outlet body 42. A sufficient seal may be obtained by a simple press fit of the outer diameter of cover 40 into a lower bore of body 42, as shown, or may be supplanted by friction or ultrasonic welding, adhesive, or other sealing means, such that the gel conduit is a sealed subassembly. As seen in FIG. 4, cover 40 is in the form of a generally flat, circular disk with four reinforcement ribs 48 extending radially outward from central flange 38. The lower surface of cover 40 is otherwise flat to keep from entraining air pockets as the dispenser is filled with water. As seen in FIGS. 3 and 5, outlet body 42 is molded to have a spiral groove 43 completing more than four complete revolutions as it traverses from a center of the body, where it receives just-dispensed gel from the inlet, to a vertically directed outlet channel 50 that leads to horizontal outlet passage 52. Passage 52 ends at outlet 46, which is surrounded by a raised lip 54 positioned to engage and seal against an inner surface of trunk 18 (FIG. 3). Thus, outlet body 42 is readily moldable, with but a single core pull needed to form outlet passage 52. Spiral groove 43 has a generally rectangular cross-section of width "a" of about 0.09 inch (2.29 millimeters) and height "b" of about 0.21 inch (5.33 millimeters), and an effective length of about 11.49 inches (29.2 centimeters), giving the gel conduit an overall product capacity of about 4.1 cubic centimeters, more than enough for a typical shave. The dispenser is capable of dispensing this heated gel, of a density of about 0.0354 pounds per cubic inch (0.98 grams per cubic centimeter) at a flow rate of about one gram per second, or about one 4 gram shave's worth in about 4 seconds.

As best seen in FIG. 6, four radial ribs 56 extend upward from the upper surface of body 42, in orthogonal directions from a central, raised hub 58. Besides reinforcing the gel conduit subassembly, ribs 56 extend beyond the radial bottom flange 60 of body 42 to form four vertical guide flanges 62, with one guide flange of increased thickness to contain the outlet passages of the flow path. As assembled, these guide flanges are received within vertical slots of the trunk, to position the gel conduit as it is moved vertically within the dispenser assembly. The cross-section of FIG. 3 is taken along two of these guide flanges, which accounts for the relatively thick appearance of the upper surface of the outlet body as shown in that view. For rapid heat transfer, the conducting walls of the gel conduit are only of about 0.020 to 0.030 inch (0.51 to 0.76 millimeter) in thickness. The two parts of the gel conduit together comprise only about 0.36 cubic inches (5.9 cubic centimeters) of polyethylene, giving the gel conduit an advantageously low effective thermal mass of about 5.5 Joules/degree Kelvin. Other materials, such as polystyrene, mylar, polypropylene, etc., may be employed.

Figure 6A:
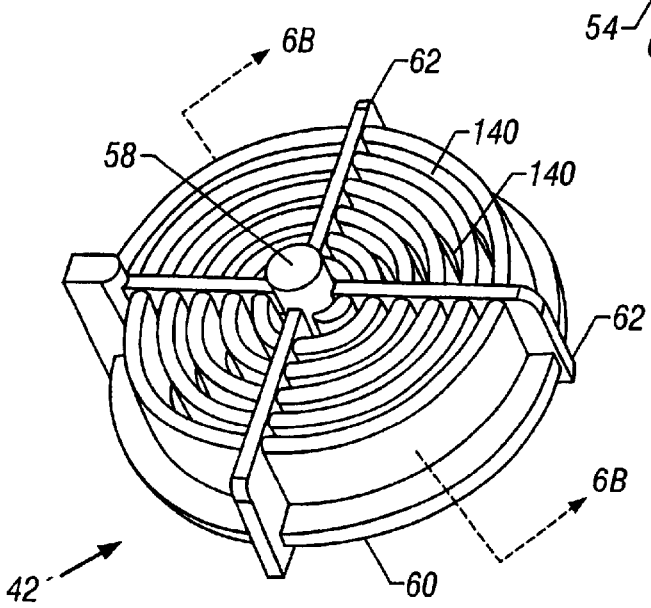
FIG. 6A is a top perspective view of an alternative outlet body.
Figure 6B:
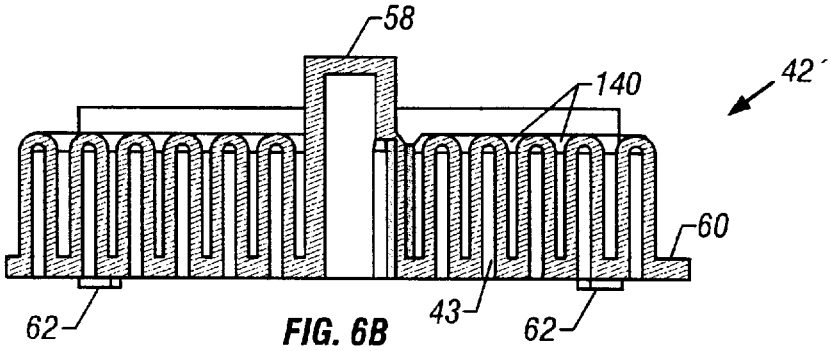
FIG. 6B is a cross-sectional view, taken along line 6B—6B of FIG. 6A.
Figure 7:
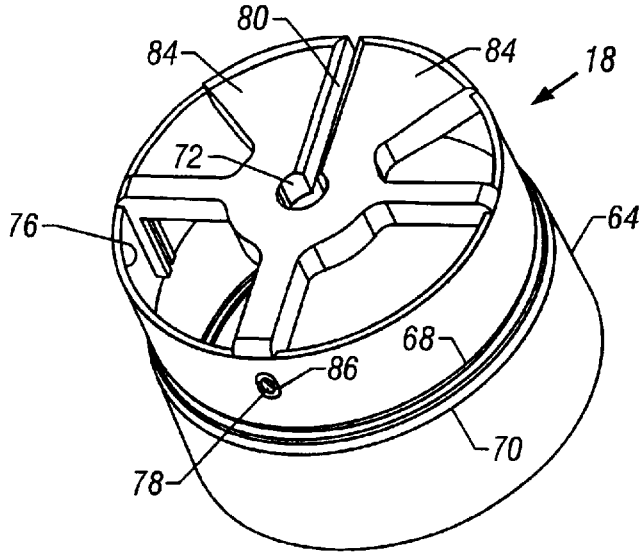
FIG. 7 is a perspective view of the trunk of the dispenser assembly.

An alternative gel conduit outlet body 42' is shown in FIGS. 6A and 6B. In this version, slots 140 have been molded into its upper surface between adjacent loops of the gel flow path, to increase the area exposed to the hot water and to decrease the thermal resistance between the water and the gel. In addition, the gel flow path cross-section has been heightened and narrowed, increasing flow resistance but greatly increasing heat transfer. Otherwise, outlet body 42' functions as described above.

Referring to FIGS. 3 and 7–10, trunk 18 is a single molded component adapted to contain and position gel conduit 20 with the dispenser assembled. Trunk 18 has a vertically descending, circular skirt 64 with an inner rib 66 extending inward toward its lower end, positioned to be received within groove 28 of can adaptor 22 to form a water-tight seal. A circumferential rib 68 about the outer surface of trunk 18, just above shoulder 70, is positioned to be received in a corresponding groove in the top cap, in a rotatable, snap fit.

The inner surfaces of the upper half of trunk 18 contain many features for interaction with gel conduit 20. A central bore 72 is sized for free, sliding engagement with central hub 58 of the gel conduit. Inwardly extending flanges 74 define channels for sliding engagement with the ribs 56 and guide flanges 62 of the gel conduit. The inner surface 76 of the upper half of trunk 18 is of a diameter selected for sliding engagement with the radial flange 60 of the gel conduit, and is slightly tapered, both for ease of molding and so as to seal against lip 54 about the outlet of the gel conduit with the gel conduit in its normal, released position. A radially directed hole 78 through the sidewall of the trunk is positioned to align with the outlet 46 of the gel conduit with the gel conduit in its depressed position. The seal at the outlet of the gel conduit, between the gel conduit and the trunk, should be sufficient to withstand the pressure of the contents of the conduit without leakage between uses. However, some leakage during storage will generally be tolerable, as it will tend to be contained within the water chamber and simply flushed away during the next use.

Figure 8:
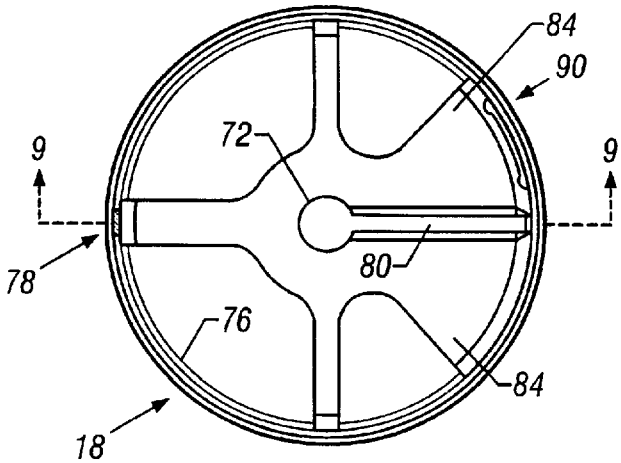
FIG. 8 is a top view of the trunk.
Figure 9:
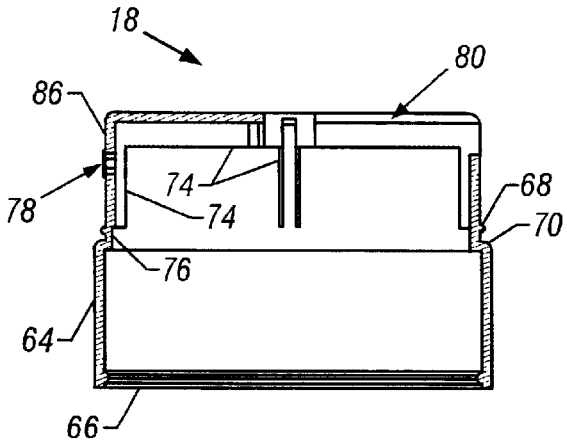
FIG. 9 is a cross-sectional view, taken along line 9—9 of FIG. 8.
Figure 10:
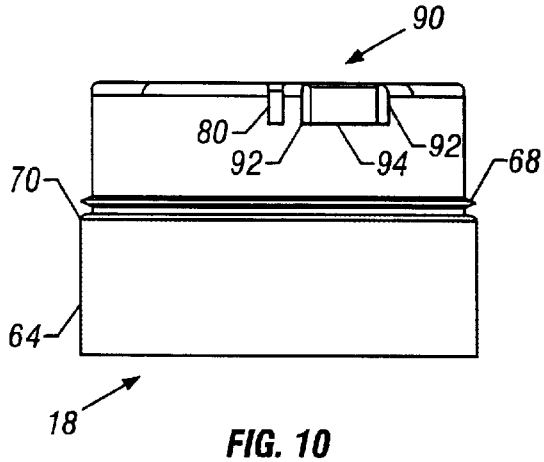
FIG. 10 is a rear view of the trunk.

The outer surfaces of the upper half of trunk 18, likewise, contain many features for interaction with top cap 16, besides rib 68 and shoulder 70. A radial slot 80 extending from bore 72 through the upper surface of trunk 18 is positioned to receive a tab 82 of the top cap (FIG. 3) with the top cap rotated to an unlocked position. Solid upper surfaces 84 of trunk 18 (FIG. 7) are engaged by the top cap tab to prevent depression of the gel conduit when the top cap is rotated to its locked position. A raised lip 86 surrounds hole 78 at the outer surface of trunk 18 and seals against an inner surface 88 of the top cap (FIG. 3) with the top cap in its locked position. As best seen in FIGS. 8 and 10, the upper edge of the trunk 18 defines a recessed area 90 with two vertical grooves 92 spanned by a region 94 of reduced diameter. This recessed area receives a corresponding vertical rib 96 of the top cap (see FIG. 12) that traverses region 94 as the top cap is rotated between its locked and unlocked positions, falling into grooves 92 at its extents of travel to provide tactile travel detents. Trunk 18 may also carry indicia (not shown) that align with a corresponding aperture in the top cap to provide a visible indication that the cop cap is in its locked or unlocked position. For example, such indicia may include the word 'OPEN' or a color that aligns with an aperture of the top cap to indicate that the cap is open.

Figure 11:
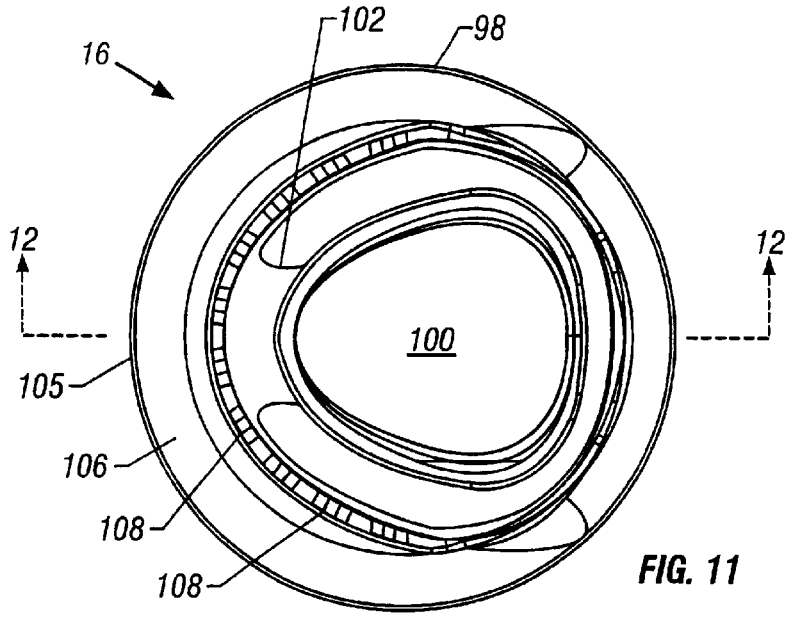
FIG. 11 is a top view of the top cap of the dispenser assembly.
Figure 12:
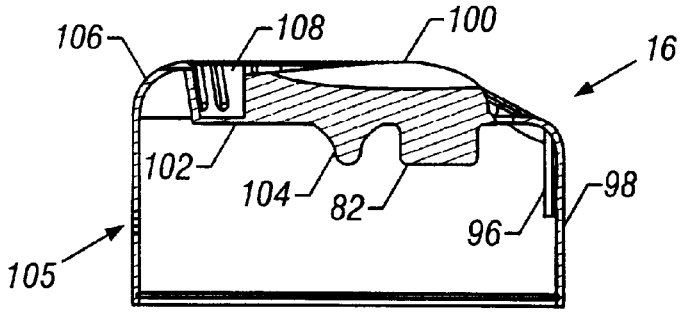
FIG. 12 is a cross-sectional view, taken along line 12—12 of FIG. 11.

Referring next to FIGS. 3 and 11–12, top cap 16 is also molded as a single piece of polyethylene, and comprises an outer shroud 98 that envelopes the upper half of trunk 18, and a trigger button 100 that is connected to shroud 98 only by a thin bridge 102 of plastic at the front edge of the button, such that button 100 is exposed to be pressed resiliently downward by the operator, flexing bridge 102 in cantilever fashion. Extending downward from a lower surface of button 100 are locking tab 82 and actuation plunger 104. Tab 82 either aligns with the corresponding slot of the trunk, or is blocked by the upper surface of the trunk, depending on the rotational position of the top cap, as described above. Plunger 104 is centrally located just above the hub 58 of gel conduit 20, such that when button 100 is depressed with the top cap in its unlocked position (as shown in FIG. 3), gel conduit 20 is moved downward within trunk 18, pushing valve adaptor 32 downward to release gel from the can into gel conduit 20. A hole 105 in the side of top cap 16 aligns with hole 78 of trunk 18 with the top cap in its unlocked position, and is moved out of alignment when the top cap is locked, thereby providing an even further seal against leakage and drool. The trunk wall and top cap wall are together only about 0.030 inch (0.76 millimeter) thick at the outlet, and their respective holes 78 and 105 of only about 0.060 inch (1.5 millimeters) diameter, such that only about 0.011 cubic centimeters of product (i.e., the volume of the short outlet passage formed by the two holes in alignment) can remain exposed for expansion and drool once the trigger button is released. Moreover, when the top cap is rotated out of alignment, to its locked position, a maximum of only about 0.0055 cubic centimeters is so exposed (i.e., the volume of hole 78), retained in an area much wider than it is deep and therefore readily washed clean under a flow of water.

The upper end of top cap 16 is open between button 100 and shroud 98, for pouring heated water into the cavity surrounding gel conduit 20, defined within trunk 18 and top cap 16 and above can adaptor 22 and having a volume of about 37 cubic centimeters. The front, upper edge of the top cap (shown to the left in FIGS. 3 and 12) is raised to form a tilt dam 106 to enable the dispenser assembly to be tilted forward about 30 degrees from vertical during use without spilling hot water from the cap, as filled to cover the upper surface of the gel conduit. The inner wall of tilt dap 106 is provided with an array of vertical slots 108 that, besides giving the dispenser assembly an aesthetic feature suggestive of fin tube radiators, form drain openings for emptying the dispenser assembly of its water as it is upended after use.

In use, the can of shaving gel or cream is held generally upright under a stream of hot water of between about 120 and 140 degrees Fahrenheit (49 and 60 degrees Celsius), such as beneath a bathroom faucet, such that the water enters and fills the dispenser assembly through the top cap, surrounding the gel conduit. If the gel conduit is empty as initially received upon retail purchase, the initial use will require depressing the trigger button to fill the gel conduit with pressurized shaving product for heating. For subsequent uses, the gel conduit will already be full of gel dispensed into the conduit during the last use and kept fresh by the seal at the conduit outlet. After waiting a relatively short length of time, heated gel may be dispensed from the conduit by depressing the trigger button to align the conduit outlet with the holes in the trunk and top cap and depress the release valve. Testing of a prototype confirmed that, starting with gel in the gel conduit at a room temperature of about 72 degrees Fahrenheit (22 degrees Celsius), filling the dispenser with hot water of about 132 degrees Fahrenheit raised the gel to a comfortable 85 degrees Fahrenheit (29 degrees Celsius), an increase of 13 degrees Fahrenheit (7.2 degrees Celsius), in only about nine seconds, and filling the dispenser with water of about 135 degrees Fahrenheit (57 degrees Celsius) raised the gel to over 89 degrees Fahrenheit (32 degrees Celsius), an increase of 17 degrees Fahrenheit (9.4 degrees Celsius), in only about 15 seconds. When the button is released, the gel conduit moves back upward, sealing the conduit outlet against the inner surface of the trunk and preventing subsequent drool of the product from the dispenser due to expansion of gel in the conduit. For travel, the top cap may be rotated to its lock position and any trace amount of product readily washed from the outside of the dispenser.

Figure 13:
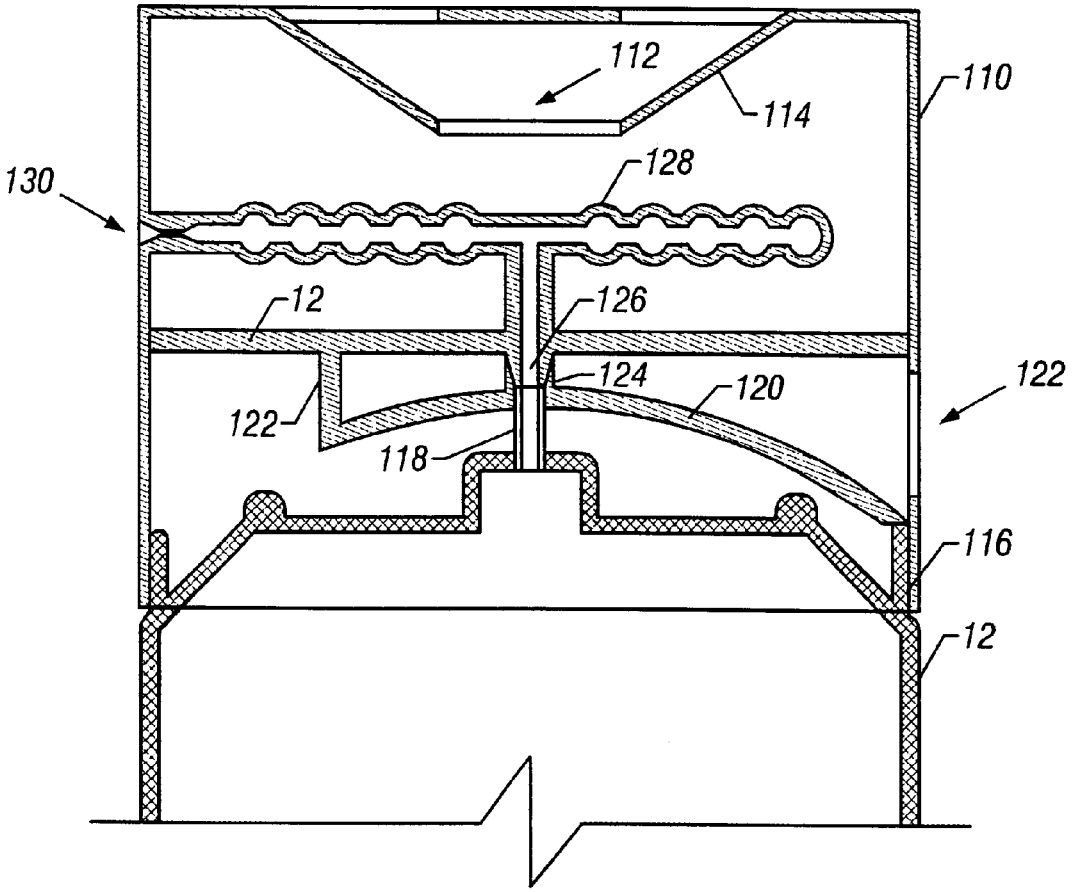
FIG. 13 is a cross-sectional view of a second heat transfer gel cap assembly.

FIG. 13 depicts a second gel cap heater/dispenser assembly. An outer shell 110 contains the other parts of the assembly and defines a circular hot water inlet 112 in its upper surface. This allows hot water to be poured into the cap and poured out of it. A baffle 114 allows the dispenser to be tipped somewhat without spilling the hot water. At the bottom of shell 110, a groove 116 clamps onto the upper edge of the dispensing canister 12 and holds the cap in place. The rail mount is such that the cap is free to rotate 360 degrees about the nozzle shaft 118 of the canister. Groove 116 may be located on the outside of outer shell 110 or hidden inside it. Actuator 120 is located through an opening 122 in the side of the outer shell, and permits finger pressure to cause the gel to be dispensed from spout 118. Actuator 120 is a 45-degree actuator as opposed to traditional vertical (i.e., 90-degree) actuators. Its side location, recess and angled pressure requirement protect against inadvertent actuation. Its finger contact surface is knurled to improve wet gripping. Actuator 120 extends from the underside of barrier 121 by an anchor 122 that serves as a center of rotation for nozzle adaptor 124 and actuator 120, helping to convert angled pressure on the actuator into a vertical downward pressure on nozzle 118, which in turn releases the gel. Anchor 122 is fixed to the bottom of barrier 121 and the inner wall of outer shell 110, and flexes as actuator 120 is pressured. Barrier 121 physically separates the hot liquid reservoir from the actuation mechanism, sealing off the hot liquid from the user's hand and the top of the can. Barrier 121 contains the inlet orifice 126 into the heat exchanger, and a fixed part of the nozzle adaptor. Nozzle adaptor 124 is a dual sleeve device with a fixed section attached to barrier 121 and the heat exchanger 128, and a moving section connecting anchor 122 and actuator 120. Both sections are hollow and liquid tight. The moving section slides over nozzle 118 of the canister. Actuator pressure lowers the moving section and nozzle 118 together, causing the canister valve to open and the gel to push out. Simultaneously, the moving section of nozzle adaptor 124 slides along the fixed section while maintaining a liquid seal, successfully transferring gel into heat exchanger 128.

Heat exchanger 128 is a chamber that holds at least ⅓ fluid ounce of liquid, and has walls made of a material having a high thermal conductivity, such as rubber, thermally conductive polymer, metal, etc. Heat exchanger 128 may be either spiral shaped or bladder shaped (as shown), and is suspended above barrier 121 to allow for its total immersion in the heated liquid and to maximize its surface area for optimal heat transfer. The heat exchanger is attached to the inner wall of outer shell 110 in four places for rigidity, one of which contains iris spout 130, through which gel is dispensed to the outside world. The inlet 126 of the heat exchanger is at its center and its outer wall is sealed to the top of barrier 121. Inlet 126 also connects to the fixed section of nozzle adaptor 124. Material and construction of the heat exchanger depend on the specifications of the temperature change required in the desired time interval.

Iris spout 130 acts as a one-way valve, permitting gel dispensing and then closing to prevent air from rendering the gel remaining in the heat exchanger from going stale over time. Iris spout 130 is located 180 degrees from actuator 120.

Although the above examples have focused on heating of pressurized shaving products, such as gels and foams, it will be understood that the invention is also applicable for the heating or cooling of other types of products, such as oils and creams.

A number of embodiments of the invention have been described. Nevertheless, it will be understood that various modifications may be made without departing from the spirit and scope of the invention. Accordingly, other embodiments are within the scope of the following claims.

What is claimed is:

1. A pressurized can of flowable material, comprising a body defining an interior volume containing the flowable material in a pressurized condition;

a valve operable to dispense a selected amount of the flowable material from the can through an outlet at an exterior surface of the can; and, between the interior volume of the body and the valve, a heat transfer device comprising an exterior housing defining an interior volume adapted to receive and hold a quantity of water at a temperature differing from that of the flowable material, and a conduit contained within the housing and forming a flow path for the flowable material between an outlet orifice of the interior volume and the valve, the conduit adapted to contain a quantity of pressurized, flowable material as thermal energy is transferred through the conduit between the water and the contained quantity of flowable material;

wherein the valve is disposed proximate the outlet and is adapted to prevent flow of pressurized material through the outlet when released.

2. The pressurized can of claim 1, defining a released material flow path, between the valve and the outlet, having a volume of no more than 0.05 cubic centimeters for containing unpressurized material downstream of the valve.

3. The pressurized can of claim 1, further comprising an operable valve at the outlet orifice of the interior volume of the body, and an exposed surface adapted to operate both valves when manually manipulated.

4. The pressurized can of claim 1, wherein the valve comprises a sliding face seal at an outlet surface of the conduit.

5. The pressurized can of claim 4, wherein the sliding face seal is disposed less than about 0.050 inch from the exterior surface of the can.

6. The pressurized can of claim 1, wherein the pressurized material contains a propellant.

7. The pressurized can of claim 1, wherein the pressurized material expands upon being released through the valve.

8. The pressurized can of claim 1, wherein the pressurized material is a gel.

9. The pressurized can of claim 1, wherein the pressurized material is a shaving product.

10. The pressurized can of claim 1, wherein the conduit is adapted to contain a quantity of flowable product sufficient for shaving a man's face.

11. The pressurized can of claim 1, wherein the conduit has an effective thermal mass of less than about 8 Joules per degree Kelvin.

12. The pressurized can of claim 1, wherein the conduit is made of plastic resin and has a nominal wall thickness, between water in contact with an outer surface of the conduit and flowable material contained within the conduit, of less than about 0.030 inch.

13. The pressurized can of claim 1, wherein the conduit defines a spiral flow path for the flowable material.

14. The pressurized can of claim 1, wherein the conduit is adapted to contain at least ⅒ fluid ounce of flowable material.

15. The pressurized can of claim 1, wherein the conduit is adapted to contain at least ⅙ fluid ounce of flowable material.

16. The pressurized can of claim 1, wherein the conduit is adapted to contain at least ⅓ fluid ounce of flowable material.

17. The pressurized can of claim 1, wherein the heat transfer device is constructed of materials selected to safely withstand filling the housing of the heat transfer device with water at about 140 degrees Fahrenheit, for heating the flowable material contained within the conduit.

18. The pressurized can of claim 1, comprising a valve actuator exposed for engagement by a human finger and adapted to be moved from a first position, in which the actuator is blocked from actuating the valve, to a second position, in which the actuator actuates the valve to dispense flowable material when depressed.

19. The pressurized can of claim 18, further comprising an operable valve at the outlet orifice of the interior volume of the body, and wherein the actuator is blocked from actuating the valves in its first position, and actuates both valves when depressed in its second position.

20. The pressurized can of claim 1, adapted to dispense at least four cubic centimeters of temperature-modified, flowable material, as measured volumetrically prior to any expansion, within less than about six seconds, upon valve actuation.

21. A heat transfer cap assembly for use with a dispensing canister containing a pressurized shaving product, the cap assembly comprising a rail mount disposed at a lower end of the cap assembly and constructed to clamp onto an upper edge of the dispensing canister;

an outer shell defining an interior volume configured to receive and hold a quantity of hot water;

an actuator exposed for finger operation and arranged to depress a release nozzle of the canister to dispense shaving product into the cap assembly when operated;

a heat exchanger arranged to receive shaving product released from the nozzle, the heat exchanger disposed with the outer shell for exposure to hot water, and configured to hold at least ⅓ fluid ounce of shaving product while heat is transferred from the hot water, through the heat exchanger, to the shaving product held within the heat exchanger; and a spout through which heated product is dispensed from the heat exchanger, the spout adapted to close to prevent extended exposure of shaving product remaining in the heat exchanger to air.

22. The heat transfer cap assembly of claim 21, further comprising a barrier disposed between the interior volume of the outer shell and an upper surface of the canister and configured to prevent hot water in the cap assembly from contacting the canister.

23. The heat transfer cap assembly of claim 21, wherein the spout contains an iris valve.

24. The heat transfer cap assembly of claim 21, wherein the spout comprises a valve formed by alignable holes in two adjacent surfaces movable to place the holes in alignment for dispensing heated product, and to misalign the holes to prevent hydraulic communication through the valve.

25. A heat transfer cap assembly for use with a dispensing canister containing a pressurized product, the cap assembly comprising a can adaptor having an axially extending skirt constructed to snap about an upper edge of the dispensing canister to secure the cap assembly on the canister, and an axially displaceable nozzle adaptor secured to the skirt by a resilient membrane and positioned to align with a nozzle of the canister when the cap assembly is so secured;

a trunk having an axially extending skirt configured to snap about an upper edge of the can adaptor to secure the trunk to the can adaptor, and a sleeve extending axially from an upper end of the skirt, the trunk defining a radial hole extending through one side of the sleeve;

a thermal conductor disposed within the trunk and axially displaceable with respect to the trunk, the thermal conductor forming a conduit between the nozzle adaptor and a conductor outlet disposed adjacent the hole in the trunk sleeve, the outlet positioned to align with the trunk sleeve hole when the thermal conductor is pressed downward to press against the nozzle adaptor to actuate the nozzle; and a top cap axially secured to the trunk and having a button with a stem extending therefrom for engaging and pressing against the thermal conductor when the button is resiliently depressed;

the top cap, trunk and can adaptor together defining an interior cavity for receiving hot water through an upper surface of the top cap, and containing the hot water in direct contact with the thermal conductor to heat pressurized product contained therein.

26. The heat transfer cap assembly of claim 25, wherein the top cap has a skirt extending about the sleeve of the trunk and defining a hole therethrough, the top cap skirt being rotatable with respect to the trunk from an open position, in which the top cap skirt hole aligns with the trunk sleeve hole for dispensing product, to a closed position in which the top cap skirt blocks communication through the trunk sleeve hole.

27. The heat transfer cap assembly of claim 25, wherein the trunk has an upper surface defining an aperture therein, and wherein the top cap button has a projection extending therefrom and positioned to be received with the aperture as the button is depressed with the top cap in a first rotational position with respect to the trunk, and to engage the upper surface of the trunk to inhibit movement of the button with the top cap in a second rotational position with respect to the trunk.

28. The heat transfer cap assembly of claim 25, wherein the sleeve of the trunk contains guide means for maintaining a radial positioning of the thermal conductor as the thermal conductor is axially displaced within the trunk.

29. A pressurized can of shaving lubricant, comprising a body defining an interior volume containing the shaving lubricant in a pressurized condition;

a valve operable to dispense a desired amount of the shaving lubricant from the interior volume of the body; and a cap assembly mounted to the body and comprising a trigger surface exposed for manual manipulation by a user;

a valve actuator operably connected to the trigger surface and positioned to operate the valve as the trigger surface is manipulated; and a flow conduit hydraulically connecting the valve to an outlet defined in an outer surface of the cap assembly;

the outer surface of the cap assembly being rotatable with respect to the flow conduit from an open position, in which the outlet aligns with the flow conduit with the trigger surface manipulated to dispense shaving lubricant, to a closed position blocking the flow conduit.

30. The pressurized can of claim 29, wherein the outer surface of the cap assembly is of a rotatable top cap with an inner surface arranged to form a face seal against an outlet orifice of the flow conduit when the top cap is rotated to a locked position.

31. The pressurized can of claim 30, wherein the outlet circumscribes a volume, downstream of the outlet orifice of the flow conduit, of less than about 0.05 cubic centimeters.

32. The pressurized can of claim 29, wherein the flow conduit is defined within a conduit housing constructed to move axially with respect to the outlet as the trigger surface is depressed, to both align the flow conduit with the outlet and operate the valve.

33. The pressurized can of claim 29, wherein the shaving lubricant contains a propellant.

34. A pressurized can of shaving lubricant, comprising a body defining an interior volume containing the shaving lubricant in a pressurized condition;

a valve operable to dispense a desired amount of the shaving lubricant from the interior volume of the body; and a cap assembly mounted to the body and having an outer surface defining an outlet, the cap assembly comprising a trigger surface exposed for manual manipulation by a user and operably connected to the valve for opening the valve as the trigger surface is manipulated; and a flow conduit housing connected to the trigger surface to move with respect to the outer surface outlet as the trigger surface is manipulated, the flow conduit housing defining therein a flow conduit hydraulically connecting the valve to a conduit outlet orifice positioned to align with the outer surface outlet when the trigger surface is manipulated to open the valve to dispense the shaving lubricant, and to be blocked when the trigger surface is released.

35. The pressurized can of claim 34 wherein the flow conduit housing is free to move axially with respect to the outer surface outlet as the trigger surface is depressed.

36. The pressurized can of claim 34 wherein the cap assembly defines an interior volume for receiving and holding hot water, the flow conduit housing forming a heat exchanger contained within the interior volume of the cap assembly and adapted to transfer heat from hot water to shaving lubricant contained within the flow conduit.

37. The pressurized can of claim 34, wherein the flow conduit has a volume of at least 1/10 fluid ounce of flowable material.

38. The pressurized can of claim 34, defining a released material flow path, downstream of the conduit outlet orifice, having a volume of no more than about 0.05 cubic centimeters.

39. The pressurized can of claim 34, wherein the flow conduit is in the form of a spiral.

40. A method of heating and dispensing shaving product, the method comprising filling the interior volume of the heat transfer device of the pressurized can of claim 1 with heated water;

operating the valve of the can to dispense a selected amount of the flowable material through the outlet at the exterior surface of the can; and then, emptying the water from the interior volume of the heat transfer device.

41. A method of heating and dispensing shaving product, the method comprising operating the valve of the pressurized can of claim 29 to dispense a selected amount of the flowable material through the outlet defined in an outer surface of the cap assembly; and then rotating the outer surface of the cap assembly to its closed position to block the flow conduit and inhibit further dispensing of shaving product.

42. A method of heating and dispensing shaving product, the method comprising manipulating the trigger surface of the pressurized can of claim 34, thereby both aligning the flow conduit with the outer surface outlet and opening the valve to dispense the shaving lubricant; and then releasing the trigger surface, thereby blocking the flow conduit at the outlet in the outer surface of the cap assembly to inhibit further flow of shaving lubricant from the flow conduit.

43. A pressurized can of flowable material, comprising a body defining an interior volume containing the flowable material in a pressurized condition;

a valve operable to dispense a selected amount of the flowable material from the can through an outlet at an exterior surface of the can; and, between the interior volume of the body and the valve, a heat transfer device comprising an exterior housing defining an interior volume adapted to receive and hold a quantity of water at a temperature differing from that of the flowable material, and a conduit contained within the housing and forming a flow path for the flowable material between an outlet orifice of the interior volume and the valve, the conduit adapted to contain a quantity of pressurized, flowable material as thermal energy is transferred through the conduit between the water and the contained quantity of flowable material;

wherein the valve is disposed proximate the outlet and is adapted to prevent flow of pressurized material through the outlet when released; the can including a valve actuator exposed for engagement by a human finger and adapted to be moved from a first position, in which the actuator is blocked from actuating the valve, to a second position, in which the actuator actuates the valve to dispense flowable material when depressed.

44. The pressurized can of claim 43, further comprising an operable valve at the outlet orifice of the interior volume of the body, and wherein the actuator is blocked from actuating the valves in its first position, and actuates both valves when depressed in its second position.

* * * * *